US005429259A

United States Patent [19]

Robin

[11] Patent Number: 5,429,259

[45] Date of Patent: Jul. 4, 1995

[54] INTERLOCKING CRATING SYSTEM

[76] Inventor: Raymond S. Robin, 71 Leighton Ave., Yonkers, N.Y. 10706

[21] Appl. No.: 262,323

[22] Filed: Jun. 17, 1994

[51] Int. Cl.[6] ..... B65D 6/22

[52] U.S. Cl. ..... 217/65; 220/4.33

[58] Field of Search ..... 217/65; 220/4.29, 4.31, 220/4.32, 4.33

[56] References Cited

U.S. PATENT DOCUMENTS

| | | | |
|---|---|---|---|
| 2,743,029 | 4/1956 | Mautner | 217/65 |
| 2,956,705 | 10/1960 | Clingman | 217/65 |
| 2,980,285 | 4/1961 | Parsons | 217/65 |
| 3,259,264 | 7/1966 | Best et al. | 217/65 |
| 3,261,493 | 7/1966 | Smith | 217/65 |
| 3,989,157 | 11/1976 | Veenema | 217/65 |
| 3,990,599 | 11/1976 | Rowley | 217/65 |

*Primary Examiner*—Joseph Man-Fu Moy
*Attorney, Agent, or Firm*—Michael I. Kroll

[57] ABSTRACT

An interlocking crating system comprising a pair of side walls, a front wall, a rear wall, a top wall and a bottom wall. A structure is for retaining the side walls, the front wall, the rear wall, the top wall and the bottom wall together in a locked position to form a box-like configuration to transport various articles therein.

5 Claims, 2 Drawing Sheets

INTERLOCKING CRATING SYSTEM

BACKGROUND OF THE INVENTION

1. Field of the Invention

The instant invention relates generally to box-like structures and more specifically it relates to an interlocking crating system.

2. Description of the Prior Art

Numerous box-like structures have been provided in prior art. For example U.S. Pat. Nos. 695,618 to Mack; 1,736,539 to Lachman; 2,759,622 to Simmons et al.; 3,266,656 to Kridle and 4,854,461 to Daniel et al. all are illustrative of such prior art. While these units may be suitable for the particular purpose to which they address, they would not be as suitable for the purposes of the present invention as heretofore described.

MACK, AUGUSTUS F.

BOX

U.S. Pat. No. 695,618

As an article of manufacture a skeleton for boxes consisting of a continuous piece of metallic angle-bar bent to form upper cross members, corner-posts, and floor members. The ends of the angle-bar being rigidly united to form a one-piece frame, together with metallic braces extending between and riveted to opposed parallel members of the continuous one-piece frame.

LACHMAN, MAURICE

WELDED AND CALKED BODY AND PROCESS OF PRODUCING SAME

U.S. Pat. No. 17,36,539

A joint structure comprising two body elements, a uniting body having a face conforming in shape to the faces of the body elements and having an elevated member intermediate of the face of the uniting body conforming in shaped to the edges of the body elements. The faces of the body elements being welded to the face of the uniting body with the edges of the body elements adjacent to the elevated member. The elevated member has a portion overlapping the adjacent portions of the body elements. Certain of the uniting bodies having extended welding ridges extending in the same general direction as that of the elevated member and penetrating the substance of other of the united bodies.

SIMMONS, CURTIS, R.

FARROW, HUNTER A.

ANIMAL CAGE

U.S. Pat. No. 2,759,622

A boxlike animal cage of knock-down construction comprising a pair of side walls, front and rear walls and top and bottom walls. A structure is for preventing relative rattling movement between the walls comprising flanges secured to the proximate ends of the side walls and front and rear walls for slideably interconnecting the side walls in substantially right angular relation to the front and rear walls. Channel-shaped guide members are secured to the upper and lower edges of the side walls and are adapted to slideably receive the side edges of the top and bottom walls. Vertical ribs are secured to the top and bottom walls adjacent the side edges thereof. Flanges extending from the channel-shaped guide members are engageable with the ribs on the top and bottom walls for clampingly holding the top and bottom walls in position. Spring locking members are secured to the upper and lower edges of the rear wall. The spring locking members are generally channel-shaped in cross-section and includes an inwardly bent portion clampingly engageable with the top and bottom walls adjacent their rearmost edges. A component is for frictionally and detachably securing the front edges of the top and bottom wall to the front wall.

KRIDLE, CHARLES E.

DEMOUNTABLE SHIPPING CASE

U.S. Pat. Np. 3,266,656

A demountable shipping case comprising a base generally in the form of a pan having a generally flat bottom and a lip extending upward from the flat bottom generally around the periphery thereof. A cover in the form of a pan, generally similar to the base, has a flat top and a lip extending downward form the flat top generally around the periphery thereof. The cover is sufficiently different in size from the base, to facilitate an easy telescopic fit between the two. Side panels are unconnected to the base normally when the case is in an assembled configuration and when the case is demounted. Corner posts are for insertion within the corners of the base and the cover. Each has two channels, one of the channels oriented to receive the edge of a side panel and the other of the channels is oriented to receive the corresponding end of a side panel adjacent to the end of the first-mentioned panel when the case is assembled. The length of each panel is sufficiently shorter than the distance between the bottoms of the two corner-post channels receiving, respectively, the opposite ends of the panel. When the corner posts are retained within the corners of the base, the panel slips easily into the two channels. The depth of the sides of both the channels are sufficient to prevent any gap, which would expose to access from the exterior the contents of the case, at the corners between the side panels and the corner posts when the case is assembled with the cover in position. The cover and the base retains the case in an assembled configuration without the need for fastenings between contiguous parts.

DANIEL, AARON E.

RULE, DANIEL P.

STORAGE BOX

U.S. Pat. No. 4,854,461

A storage box, particularly adapted for seed storage and handling, having folded corners and sides tapered from bottom to top. The box is provided with a base member having slots engageable by the tines of a fork lift and horizontal top stacking flange which extends outwardly to the same dimensions as the base member for vertical stacking of the boxes. The box is preferably constructed of steel plate and the folded corners assure the strength and integrity of the box.

SUMMARY OF THE INVENTION

A primary object of the present invention is to provide an interlocking crating system that will overcome the shortcomings of the prior art devices.

Another object is to provide an interlocking crating system that contains a skeletal framework assembly to hold plywood panels together in a locked position, to form a box-like configuration to transport various articles therein.

An additional object is to provide an interlocking crating system in which the skeletal framework consists of a plurality of panel holders, corner lock members and rail members that fit and interlock together to maintain the box-like configuration with plywood, plastic, metal or any suitable material panels.

A further object is to provide an interlocking crating system that is simple, reusable, recyclable, and easy to use.

A still further object is to provide an interlocking crating system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
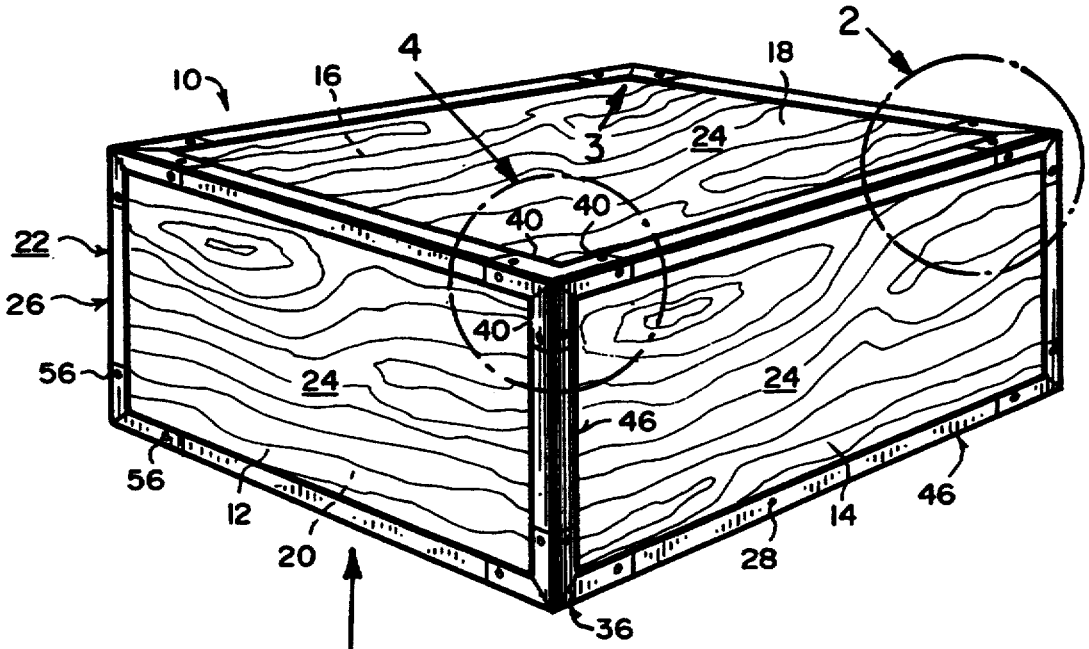
FIG. 1 is a perspective view of the instant invention.
Figure 2:
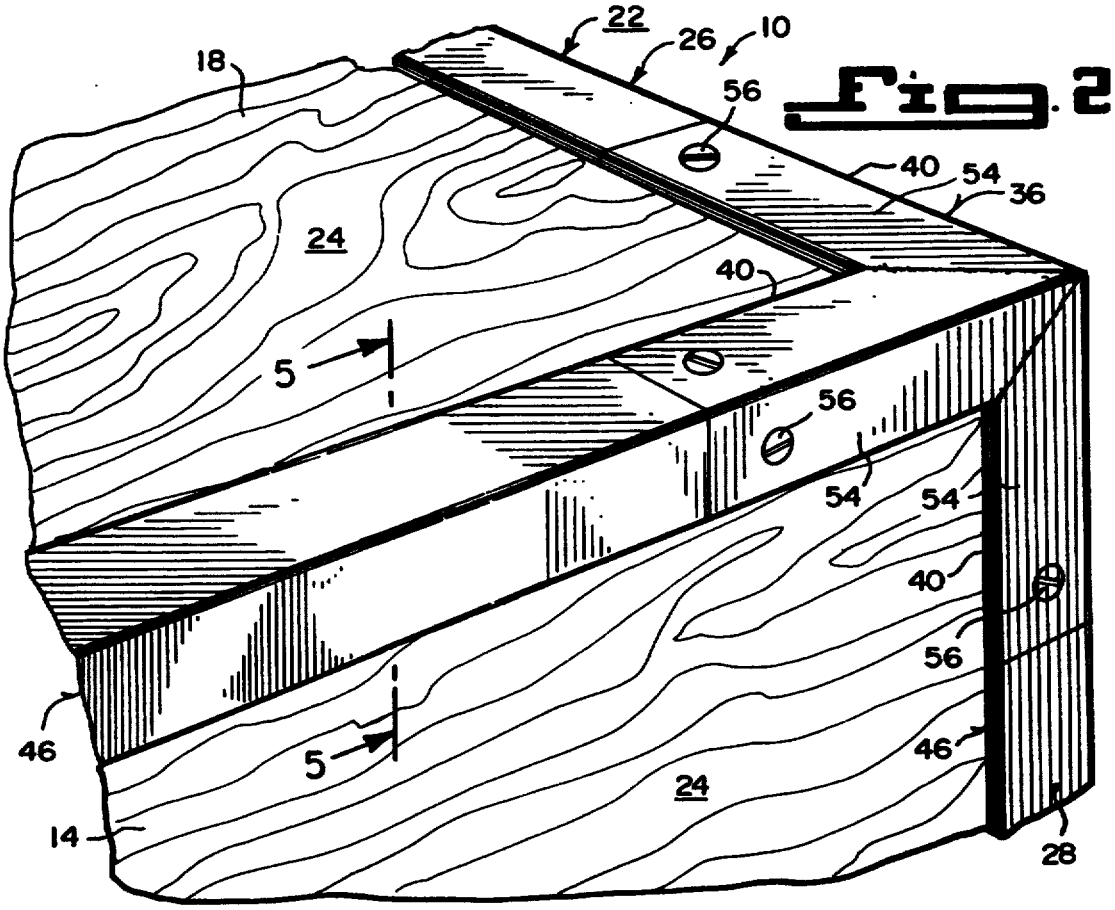
FIG. 2 is an enlarged perspective view of a corner thereof as indicated by arrow 2 in FIG. 1.

Turning now descriptively to the drawings, in which similar reference characters denote similar elements throughout the several views, FIGS. 1 through 5 illustrate an interlocking crating system 10 comprising a pair of side walls 12, a front wall 14, a rear wall 16, a top wall 18 and a bottom wall 20. A structure 22 is for retaining the side walls 12, the front wall 14, the rear wall 16, the top wall 18 and the bottom wall 20 together in a locked position to form a box-like configuration to transport various articles therein.

The side walls 12, the front wall 14, the rear wall 16, the top wall 18 and the bottom wall 20 are all constructed out of plywood, plastic, metal, or any suitable material panels 24. The retaining structure 22 is a skeletal framework assembly 26. The skeletal framework assembly 26 is fabricated out of extruded plastic or any suitable material 28.

Figure 5:
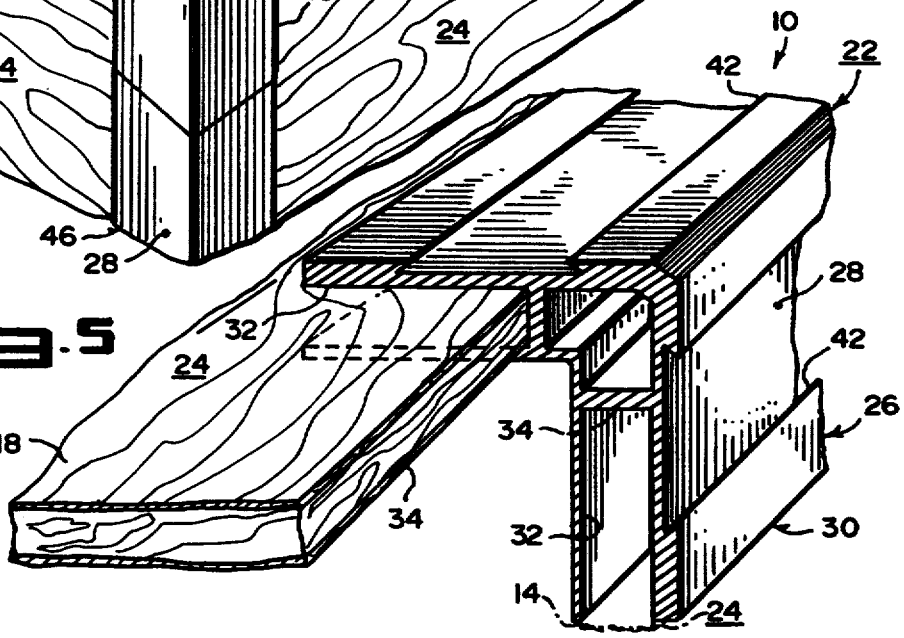
FIG. 5 is an enlarged cross sectional perspective view taken along line 5—5 in FIG. 2, showing a portion of one typical panel holder.

The skeletal framework assembly 26, as best seen in FIG. 5, includes a plurality of L-shaped panel holders 30. Each panel holder 30 has two slots 32 for receiving two edges 34 of two plywood, plastic, metal, or any suitable material panels 24 therein at right angles to each other.

The skeletal framework assembly 26 further includes a plurality of L-shaped fabricated corner lock members 36. Units 38 are for holding each corner lock member 36 onto portions of three adjacent panel holders 30. Each corner lock member 36 contains three intersecting L-shaped arms 40 that are welded together.

Each corner lock holding unit 38 consists of each panel holder 30 having a pair of longitudinal dovetail grooves 42 therealong. Each arm 40 of each corner lock member 36 has a pair of longitudinal dovetail tongues 44 therealong, to fit into and interlock with the pair of dovetail grooves 42 in one panel holder 30.

The skeletal framework assembly 26 further contains a plurality of L-shaped rail members 46. Components 48 are for holding each rail member 46 onto one panel holder 30 between two corner lock members 36. Each rail member holding component 48 includes each rail member 46 having a pair of longitudinal dovetail tongues 50 therealong, to fit into and interlock with the pair of dovetail grooves 42 in one panel holder 30.

Figure 3:
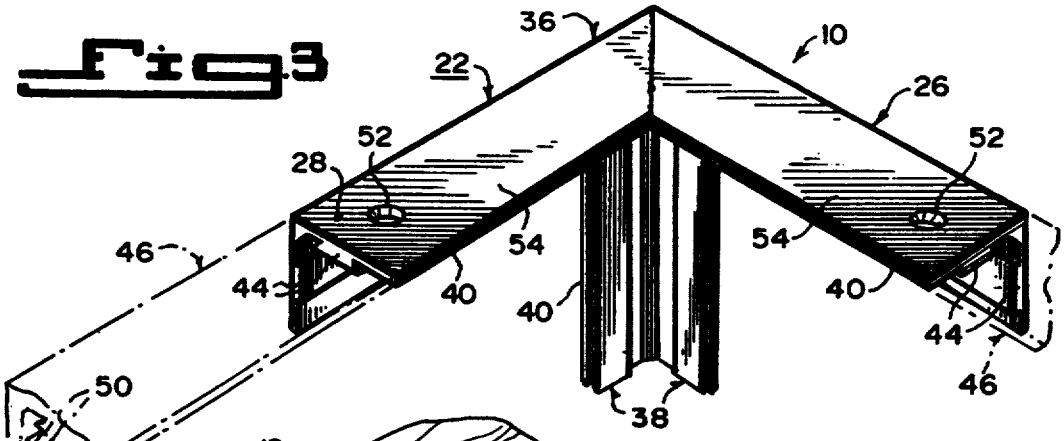
FIG. 3 is an enlarged perspective view of one typical corner lock member taken in the direction of arrow 3 in FIG. 1.
Figure 4:
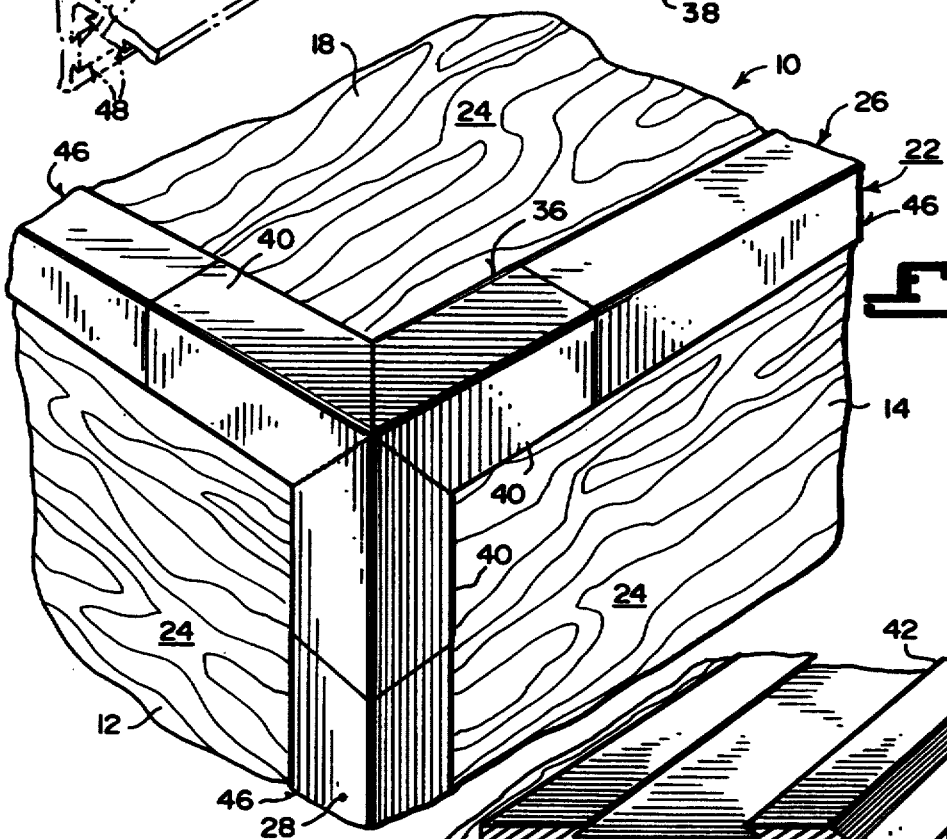
FIG. 4 is an enlarged perspective view of another corner thereof as indicated by arrow 4 in FIG. 1 without the setscrews.

Each corner lock member 36 can further consist of each arm 40 having a pair of apertures 52, each located in one segment 54 of each arm 40, as shown in FIG. 3. A plurality of setscrews 56 are provided. Each setscrew 56 fits into one aperture 52 and threads into one panel holder 30 for securing each corner lock member 36 thereto.

Typical sizes for the various elements of the interlocking crating system 10:

1. Plywood, plastic, metal, or any suitable material panel 24—three eighths to one half inch thickness and in lengths up to sixteen feet.
2. Each L-shaped panel holder 30—two inches by two inches and in lengths six feet to sixteen feet long.
3. Each arm 40 of the L-shaped fabricated corner lock member 36—two inches by two inches and in lengths of three inches, six inches and nine inches.
4. Each L-shaped rail member 46—two inches by two inches and in lengths six feet to sixteen feet long.

LIST OF REFERENCE NUMBERS

10 interlocking crating system side wall
14 front wall
16 rear wall
18 top wall
20 bottom wall
22 retaining structure
24 plywood, plastic, metal, or any suitable material panel
26 skeletal framework assembly for 22
28 extruded plastic or any suitable material of 26
30 L-shaped panel holder
32 slot in 30
34 edge of 24
36 L-shaped fabricated corner lock member
38 corner lock holding unit
40 L-shaped arm of 36
42 dovetail groove in 30
44 dovetail tongue on 40
46 L-shaped rail member
48 rail member holding component
50 dovetail tongue on 48
52 aperture in 54
54 segment of 40
56 setscrew It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is desired to be protected by Letters Patent is set forth in the appended claims:

1. An interlocking crating system comprising:
   a) a pair of side walls;
   b) a front wall;
   c) a rear wall;
   d) a top wall;
   e) a bottom wall; and
   f) skeletal framework means for retaining said side walls, said front wall, said rear wall, said top wall and said bottom wall together in a locked position to form a box-like configuration to transport various articles therein, said skeletal framework means comprising a plurality of L-shaper holders having a pair of legs at right angles to each other, said legs having slots between inner and outer faces of said legs for receiving the edges of adjacent walls at right angles to each other, a longitudinal dovetail groove formed in the outer face of each of said legs, a plurality of corner members each having three intersecting L-shaped arms mounted over said L-shaped holders where said holders come together at each corner of said box-like configuration, said arms having longitudinal dovetail tongues for fitting into and interlocking with said dovetail grooves, and means for securing said corner members to said L-shaped holders comprising setscrews threaded into said L-shaped holders through said corner members.

2. An interlocking crating system as recited in claim 1, wherein said side walls, said front wall, said rear wall, said top wall and said bottom wall are all constructed out of plywood panels.

3. An interlocking crating system as recited in claim 1, wherein said skeletal framework assembly further includes:
   a) a plurality of L-shaped rail members; and
   b) means for holding each said rail member onto one said panel holder between two said corner lock members.

4. An interlocking crating system as recited in claim 3, wherein each said rail member holding means includes each said rail member having a pair of longitudinal dovetail tongues therealong, to fit into and interlock with said pair of dovetail grooves in one said panel holder.

5. An interlocking crating system as recited in claim 1, wherein said skeletal framework assembly is fabricated out of extruded plastic.

* * * * *